US005361081A

United States Patent [19]

Barnaby

[11] Patent Number: 5,361,081

[45] Date of Patent: Nov. 1, 1994

[54] PROGRAMMABLE PIXEL AND SCAN-LINE OFFSETS FOR A HARDWARE CURSOR

[75] Inventor: Michael J. Barnaby, West Boylston, Mass.

[73] Assignee: Digital Equipment Corporation, Maynard, Mass.

[21] Appl. No.: 55,000

[22] Filed: Apr. 29, 1993

[51] Int. Cl.[5] ..... G09G 3/02

[52] U.S. Cl. ..... 345/145; 345/157

[58] Field of Search ..... 340/709; 358/22; 345/157, 145, 162, 120, 115

[56] References Cited

U.S. PATENT DOCUMENTS

| | | | |
|---|---|---|---|
| 3,911,419 | 10/1975 | Bates et al. | 345/162 |
| 4,259,725 | 3/1981 | Andrews et al. | 345/145 |
| 4,317,114 | 2/1982 | Walker | 345/114 |
| 4,317,956 | 3/1982 | Torok et al. | 345/157 |
| 4,365,242 | 12/1982 | Yasuda et al. | 345/145 |
| 4,566,000 | 1/1986 | Goldman et al. | 345/145 |
| 4,625,202 | 11/1986 | Richmond et al. | 345/145 |
| 4,668,947 | 5/1987 | Clarke, Jr. et al. | 345/145 |
| 4,691,200 | 9/1987 | Stephany | 345/157 |
| 4,706,074 | 11/1987 | Muhich et al. | 345/157 |
| 4,751,502 | 6/1988 | Ishii et al. | 345/157 |
| 4,768,029 | 8/1988 | Burrows | 345/145 |
| 4,868,548 | 9/1989 | Gelvin | 345/145 |
| 4,870,406 | 9/1989 | Gupta et al. | 345/145 |
| 4,891,705 | 1/1990 | Suzuki et al. | 345/115 |
| 4,959,803 | 9/1990 | Kiyohara et al. | 345/120 |
| 4,987,527 | 1/1991 | Hamada et al. | 345/157 |
| 4,987,551 | 1/1991 | Garrett, Jr. | 345/145 |
| 5,146,211 | 9/1992 | Adams et al. | 345/145 |

*Primary Examiner*—Alvin E. Oberley
*Assistant Examiner*—Vivian W. Chang
*Attorney, Agent, or Firm*—Mary M. Steubing; Ronald C. Hudgens; Albert P. Cefalo

[57] ABSTRACT

An apparatus and method for positioning a cursor on a video display having a horizontal blank time and a vertical blank time, where the cursor is addressed by a match position representing the cursor hot point relative to the origin of a pixel matrix, including cursor position registers for providing (x,y) cursor positioning coordinates; adders for adding to the (x,y) coordinates values representing the horizontal and vertical blank times respectively; and subtracting circuits for subtracting from the result values representing the horizontal and vertical match positions to provide the actual screen position at which the cursor is displayed. Accordingly, partial blanking and variable cursor hot points are supported in a manner transparent to the cursor positioning software.

5 Claims, 11 Drawing Sheets

PROGRAMMABLE PIXEL AND SCAN-LINE OFFSETS FOR A HARDWARE CURSOR

The invention relates to video displays and in particular to positioning a cursor on a video display.

BACKGROUND OF THE INVENTION

Video displays are used to provide a text and graphics interface for a computer user. In a typical high resolution graphics display system, the display image is held in a memory buffer in the form of a bit map, where each picture element (pixel) is defined by one or more bits. In operation, data is read from the buffer in synchronization with the raster scan of the display and converted to serial form to produce a video signal for driving the display.

Such display systems normally have a pointing device, for example a mouse or joystick, for pointing to areas on the display. The physical movements of the pointing device are translated into X-Y coordinates defining the position of a graphical cursor within the display image. The cursor allows the user to interact with the graphical interface. The cursor may be used, for example, to select menus in a windows environment, or to select a particular application to be run. The cursor may appear on the screen simply as a pair of crosshatched lines, or it may be represented by a more complex icon such as an arrow. The point on the cursor image used for selecting items is known as the hot point. For the crosshatched cursor, the hot point is located at the center of the cursor image. For an arrow cursor, the hot point is located at the point on the cursor image representing the arrow tip. For example, for a left pointing arrow, the hot point is located at the upper left corner of the cursor image.

The cursor may be controlled entirely by the computer system software, wherein the cursor positioning software is responsible for replacing data in the video buffer at the appropriate locations with the data representing the cursor and for updating the contents of the video buffer as the cursor is moved.

Alternatively, the cursor may be partially controlled by supporting hardware. In such implementations, the cursor is typically stored as a bit map image in a high speed static memory, for example as a 64×64 pixel matrix. Software loads position registers in the hardware with cursor position data which defines the cursor position relative to the top left pixel of the display. The position of the cursor is referenced to its hardware origin, usually the top left pixel of the cursor pixel matrix. The cursor data is read out of the high speed memory, serialized, and aligned and combined with the serialized image display data to produce an output video signal representing the image with the cursor superimposed at the required position. Video buffer updates for each movement of the pointing device are thus avoided, and performance is accordingly enhanced.

However, available hardware cursor implementations restrict the positioning of the cursor relative to the image display, which results in increased software overhead and management for systems supporting windowing environments such as X-Windows ® and MS-Windows ®.

One problem results from the manner in which present hardware cursor implementations reference cursor positions on the display. The displayed image consists of an active interval, in which the pixels are displayed, surrounded by a blanking interval, which appears as a black area surrounding the active interval. Present hardware cursor implementations define the origin of the display as the top left pixel position, which occurs at the start of the active region for the display. The hardware origin of the cursor bitmap may be defined, for example, as the top left corner of the cursor bitmap. In such an implementation, the hardware origin of the cursor cannot be moved beyond the top or left edge of the active interval. Thus, if the cursor image is for example a right pointing arrow with a hot point in the upper right corner of the pixel matrix, the upper left pixels of the display cannot be selected. Windowing environments require that in such a case, the cursor image should overlap the edge of the active interval so that the cursor is partially displayed, and the hot point of the cursor can be used to select pixels at the edge of the active interval.

Some hardware cursor implementations provide support for a partially displayed cursor by redefining the origin of the display within the blanking interval, rather than at the start of the active interval. Such implementations thus require software to add an offset value representing the blanking interval to the cursor position data. For systems supporting multiple display types with different blanking interval times, the software addition of blanking offset values results in increased software overhead and management. In addition, when the video pipeline hardware is subject to a design change, thus changing the blanking interval timing, software modifications are required.

Other hardware cursor implementations leave the origin of the display at the start of the active interval, but provide X-Y offset registers to support partial display of the cursor. According to one such implementation, the hardware origin of the cursor is defined as the upper right pixel of the pixel matrix. The values in X-Y the offset registers are subtracted from the upper right corner position of the cursor matrix, thus shifting the origin of the cursor matrix relative to the origin of the image display. Such implementations are disadvantageous in that they require software to keep track of the position of the cursor relative to the edges of the screen, and continuously update the offset registers accordingly. Increased software overhead results.

A further complication results for windowing environments that require the support of multiple cursor icons or fonts. Typical hardware cursor implementations implement the cursor as a bit map, for example as a 64×64 pixel matrix, which is overlayed onto the image data relative to the cursor hardware origin, typically defined as the upper left corner of the pixel matrix. However, windowing software positions a cursor icon by its hot point. Some of the cursor icons used by the windowing software may have hot points effective at a location other than the hardware origin of the cursor bit map, for example the upper right corner or the center. The difference between the hot point of the cursor and the origin of the hardware cursor is here referred to as the match position. In cases where the hot point is not located at the origin of the hardware cursor, software must scale the difference between the match position and the hardware cursor origin for proper operation of the windowing software. Again, increased software overhead and management result s, particularly where the match position changes for different displayed windows.

SUMMARY OF THE INVENTION

It is desirable to provide a hardware cursor which supports partially blanked cursors and cursors with variable match positions in a manner which is transparent to software in order to decrease software overhead and management.

In accordance with the present invention, a method of positioning a cursor on a video display having a horizontal blank time and a vertical blank time is provided. The cursor is displayed as a pixel matrix having a cursor origin in a corner of the matrix and a cursor hot point located within the matrix. The method includes the steps of providing cursor position coordinates comprising an X coordinate and a Y coordinate; adding to the X coordinate a value representing the horizontal blank time of the display to provide a horizontal offset position; adding to the Y coordinate a value representing the vertical blank time of the display to provide a vertical offset position; subtracting from the horizontal offset position a horizontal match position representing the difference between the horizontal position of the hot point and the horizontal position of the origin to provide a horizontal adjusted position; subtracting from the vertical offset position a vertical match position representing the difference between the vertical position of the hot point and the vertical position of the origin to provide a vertical adjusted position; and displaying the cursor at the display position corresponding to the horizontal and vertical adjusted positions.

According to a further aspect of the invention, an apparatus is provided for positioning a cursor on a video display having a horizontal blank time and a vertical blank time. The apparatus includes means for providing cursor coordinates comprising an X coordinate and a Y coordinate; means for adding to the X coordinate a value representing the horizontal blank time of the display to provide a horizontal offset position; means for adding to the Y coordinate a value representing the vertical blank time of the display to provide a vertical offset position; means for subtracting from the horizontal offset position a horizontal match position representing the difference between the horizontal position of the hot point and the horizontal position of the origin to provide a horizontal adjusted position; means for subtracting from the vertical offset position a vertical match position representing the difference between the vertical position of the hot point and the vertical position of the origin to provide a vertical adjusted position; and means for displaying the cursor at the display position corresponding to the horizontal and vertical adjusted positions.

With such an arrangement, software references the cursor by its hot point, and references the (0,0) cursor position as the first displayed pixel; that is, cursor position (0,0) occurs at the start of the active interval. Hardware adds offset values corresponding to the blanking intervals to the cursor position provided by software, and subtracts the match position, which is the difference between the hot point and the origin of the cursor, from the result. Partial cursor blanking and variable match positions are thus supported in a manner transparent to software, resulting in increased system performance and efficiency.

DETAILED DESCRIPTION OF THE PREFERRED EMBODIMENT

Figure 1:
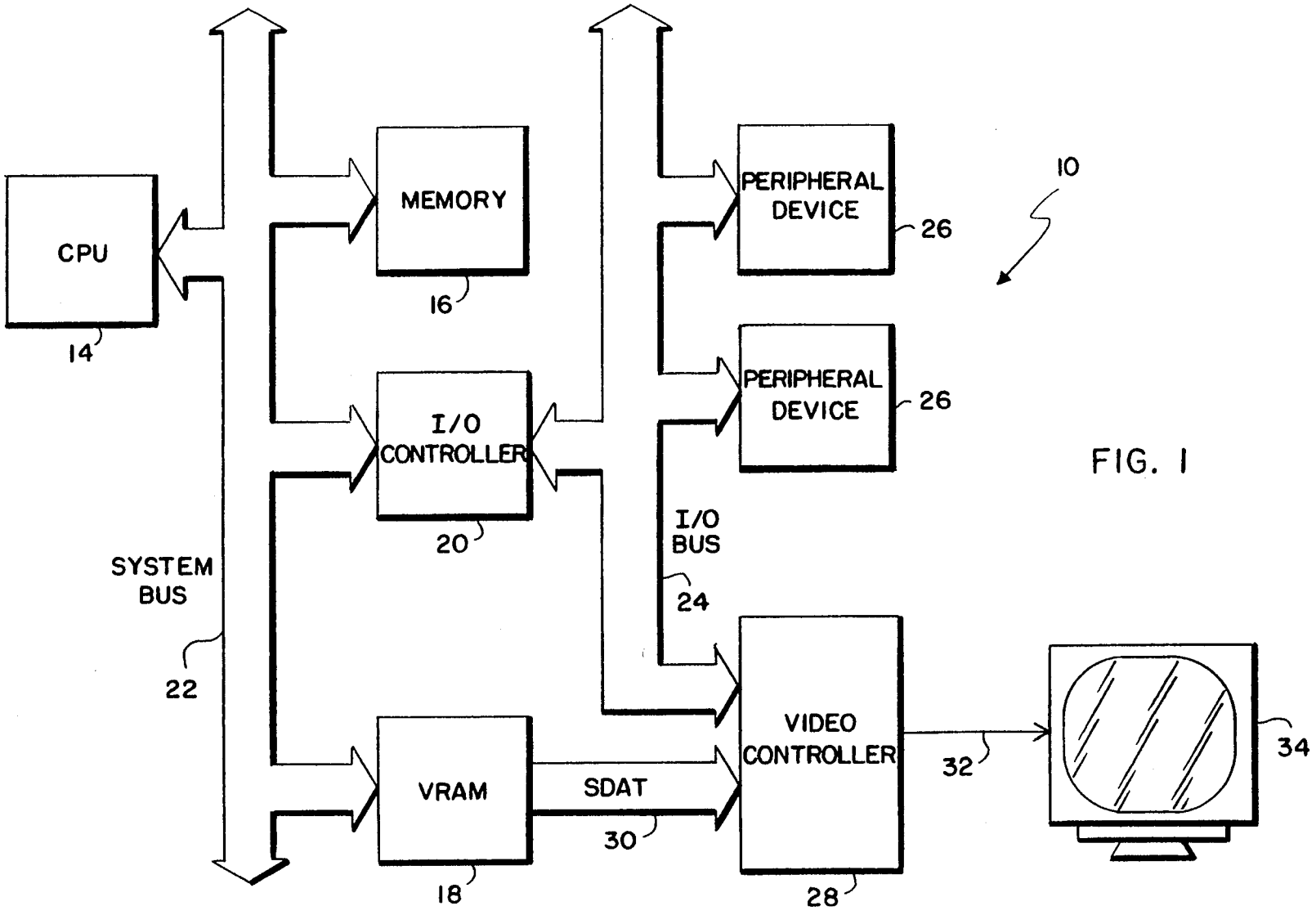
FIG. 1 is a block diagram of a computer system including a video controller coupled to a video display.

Referring now to FIG. 1, computer system 10 is shown to include a central processing unit (CPU) 14, a main memory 16, a video memory 18, and an I/O bus controller 20, all interconnected by system bus 22. Coupled to I/O bus controller 20 is an I/O bus 24 which interfaces with various peripheral devices 26 and a video controller 28. The video memory 18 feeds serial video data 30 to the video controller 28. The video controller 28 drives video data on lines 32 to be displayed on a video display 34.

Video display 34 may be a cathode ray tube (CRT) display, a liquid crystal display (LCD), an electroluminescent (EL) panel display, or any display technology which relies on the continuous refreshing of multiple horizontal scan lines. Here, the video display 34 is a 1024×768 8 plane color CRT. That is, the video display 34 displays 768 horizontal lines of 1024 pixels each, where each pixel is represented by 8 bits of data.

Figure 2:
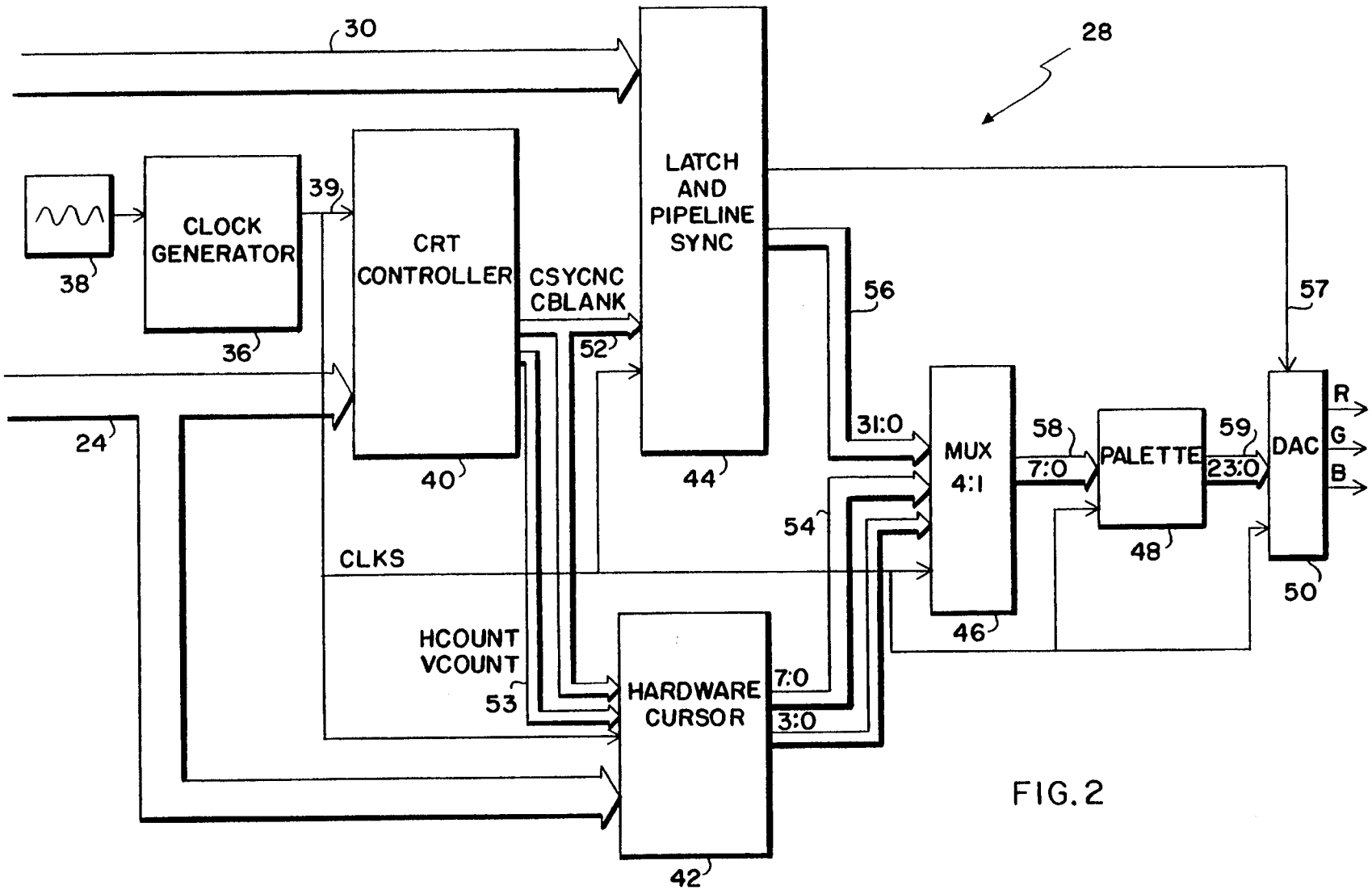
FIG. 2 is a block diagram of the video controller of FIG. 1 including a hardware cursor.

Referring now to FIG. 2, the video controller 28 is shown in further detail. The video controller 28 includes a clock generator 36 which is fed by a phase locked loop 38 with a frequency equal to the pixel rate. The clock generator provides divide-down clock signals on lines 39 to a cathode ray tube (CRT) controller 40, a hardware cursor 42, a latch and pipeline sync generator 44, multiplexers 46, a palette 48, and a digital to analog convertor 50.

The CRT controller 40 accepts as input the clock signals on lines 39 and the I/O bus 24, and is configured via the I/O bus 24 to generate video timing signals on lines 52 necessary for proper operation of the video display. These signals include CSYNC and CBLANK. The CRT controller 42 also provides the signals HCOUNT and VCOUNT on lines 53, which represent the position on the display 34 which is currently being refreshed, to the hardware cursor 42.

The hardware cursor 42 accepts as input the I/O bus 24 and the video timing signals CSYNC and CBLANK on lines 52 and the signals HCOUNT and VCOUNT on lines 53 from the CRT controller 36. The hardware cursor 42 is configured via the I/O bus 24 to generate cursor data on lines 54 and transparency data on lines 55 which are fed to the multiplexers 46.

The latch and pipeline sync generator 44 is fed the video timing signals CSYNC and CBLANK from the CRT controller 40, and is fed the 32 bit serial data on lines 30 from the video memory 18 (FIG. 1). The latch 44 latches the serial data on lines 30 at the proper times and provides 32 bits of video data on lines 56. The latch and pipeline sync generator also provides pipeline SYNC and BLANK video timing signals to the DAC 50 on lines 57. These pipelined video timing signals are synchronized with the pixel data received by the CRT.

The multiplexers 46 multiplex the video data on lines 56 and the cursor data on lines 54 to provide 8 bits of pixel data, representing one eight plane pixel, on lines 58. The transparency data on lines 55 are used to select cursor data on lines 54 to be driven through the multiplexers 46 at times during which the CRT 34 guns are refreshing screen positions for which the cursor is to be displayed, and are used to select the video data at all other times. The pixel data on lines 58 are fed to the palette 48, which acts as a color lookup table for assigning color levels to the pixel data values. The palette 48 provides 24 bits of color pixel data on lines 59, eight bits per color, which are converted by the DAC 50 to analog data (RGB data) for feeding the red, green, and blue guns of the CRT. The DAC 50 also provides the pipelined SYNC and BLANK information on lines 57 to the green gun.

Figure 3:
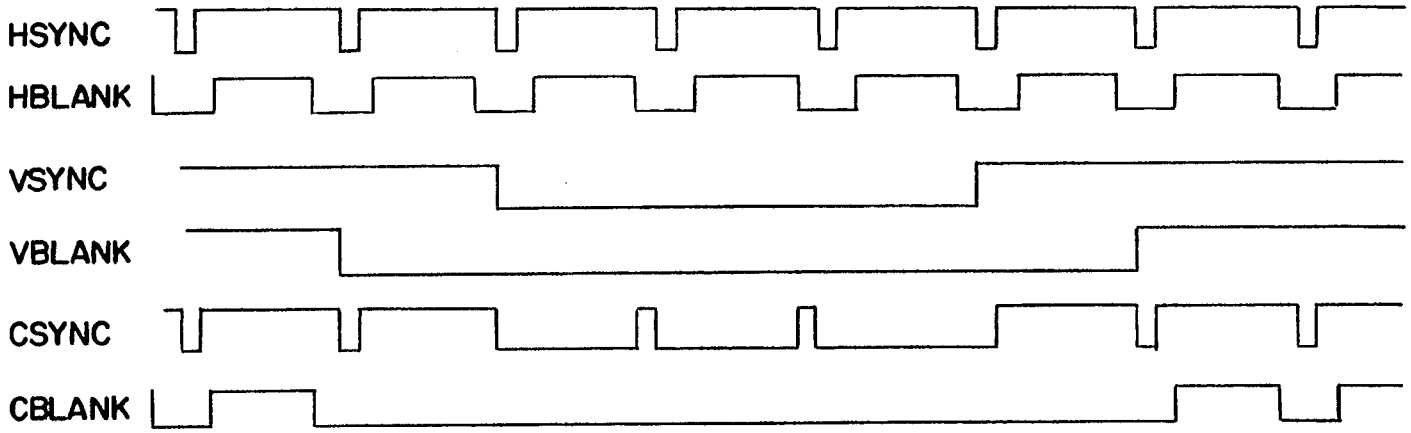
FIG. 3 is a timing diagram representing the video timing signals.
Figure 4:
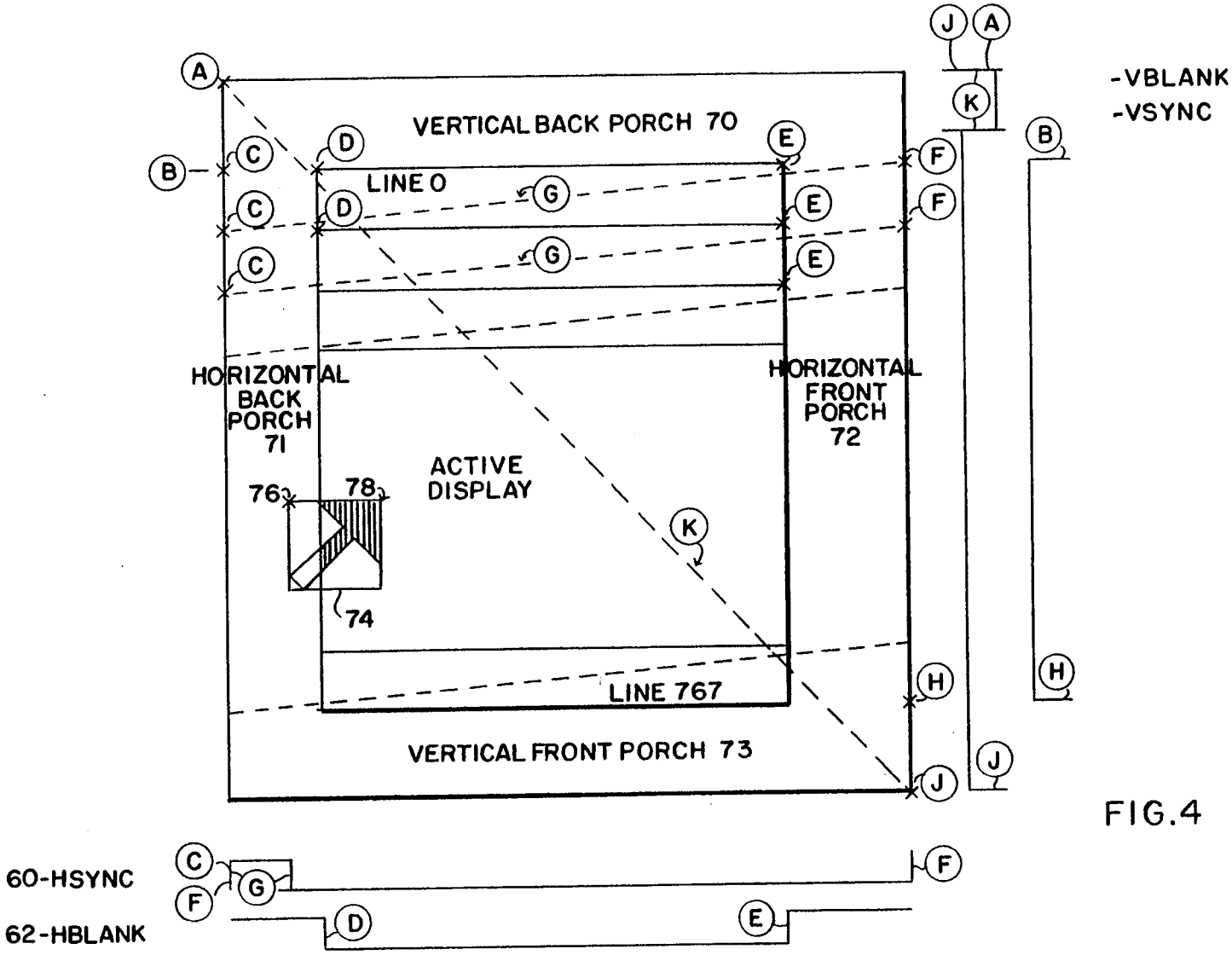
FIG. 4 is a representation of a raster video display relative to the video timing signals of FIG. 3.

The video display 34 continuously refreshes each pixel of information on the screen by sweeping an electron beam across successive horizontal scan lines from the top of the display to the bottom. The video timing signals CSYNC and CBLANK generated by the CRT controller 40 control the timing of the beam as it sweeps line by line down the screen. Referring to FIG. 3, The CSYNC and CBLANK signals are composite signals in which the video timing signals HSYNC, VSYNC, HBLANK, and VBLANK are embedded. Referring now to FIG. 4, there are shown the video timing signals HSYNC (60), HBLANK (62), VSYNC (64), and VBLANK (66) as they relate to the active display 68.

A vertical frame begins in the upper left corner (labeled 'A') of the display with the rising edge of the VSYNC signal 64. The falling edge of the VBLANK signal 66 then signals the start of the active display 68 ('B'). The time between which the VSYNC signal 64 falls and the VBLANK signal 66 falls is known as the vertical back porch 70, and appears as a blank, black area on top edge of the active display 68.

The rising edge of the HSYNC signal 60 signals the start of a horizontal scan line ('C'). The falling edge of the HBLANK signal 62 then signals the start of the active region of the horizontal scan line ('D'). The time between which the HSYNC signal 60 falls and the HBLANK signal 62 falls is known as the horizontal back porch 71, and appears as a blank, black area on the left edge of the active display 68.

The rising edge of the HBLANK signal 62 indicates the end of the active region of the scan line ('E'), and the rising edge of the HSYNC signal 60 indicates the end of the horizontal scan line ('F'). The time between the rising edge of the HBLANK signal 62 and the rising edge of the HSYNC signal 60 is known as the horizontal front porch 72, and appears as a blank, black area on the right edge of the active display 68. The rising edge of the HSYNC signal 60 begins the next horizontal scan line. A portion of the time between which the HSYNC signal rises and falls is used to retrace the electron beam from the right side of the screen to the left in order to start the display of the next horizontal scan line ('G', dotted lines).

After all 768 lines on the screen have been traced, the rising edge of the VBLANK signal 66 indicates the end of the active display 68 ('H'). The rising edge of the VSYNC signal 64 then indicates the end of the vertical frame ('J'). The time between the rising edge of the VBLANK signal 66 and the rising edge of the VSYNC signal 64 is known as the vertical front porch 73. this area appears as a blank, black area on the bottom edge of the active display 68. A portion of the time between which the VSYNC signal 64 rises and falls is used to retrace the electron beam at the upper left corner of the screen ('K', dotted line), and the process repeats.

Also shown in FIG. 4 is an arbitrarily positioned cursor 74 having a cursor origin 76 and a hot point 78. The cursor is displayed as a 64×64 pixel matrix. In the cursor position shown, the cursor 78 is partially blanked; that is, part of the cursor 78 overlaps the horizontal back porch 71, the overlapping part remaining undisplayed. Also, the hot point 78, used by the cursor positioning software to position the cursor, does not match the fixed cursor origin 76 used by the hardware cursor 42 to control the position of the cursor 74 on the display 34.

Figure 5:
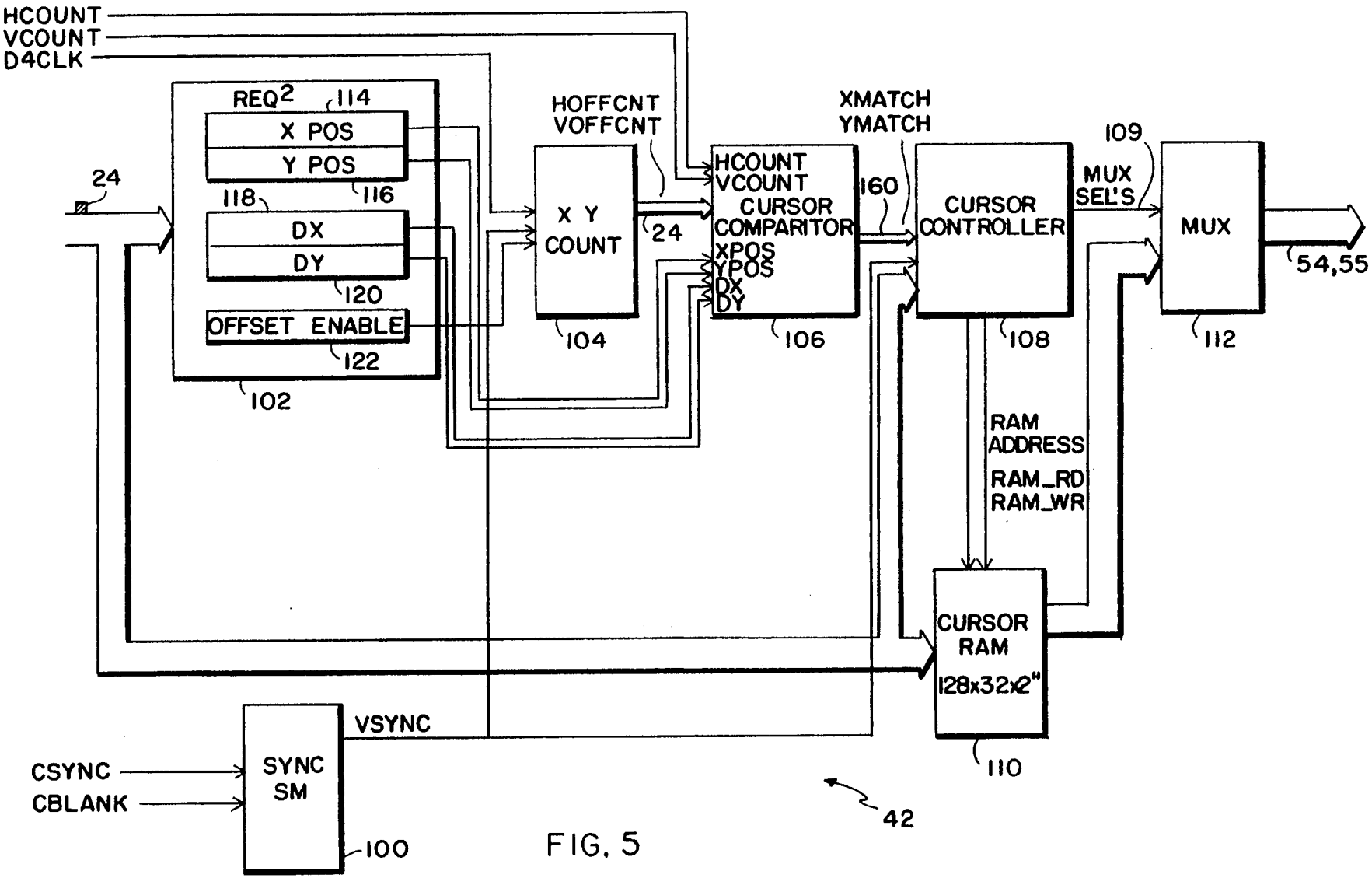
FIG. 5 is a block diagram of the hardware cursor of FIG. 2.

Referring now to FIG. 5, there is shown a block diagram of the hardware cursor 42 (FIG. 2) which provides for the display of the partially blanked cursor 74 shown in FIG. 4. The hardware cursor 42 includes a sync state machine 100 for generating the HSYNC, HBLANK, VSYNC, and VBLANK signals used throughout the hardware cursor 42. Also included are registers 102 coupled to an X-Y counter 104, which feeds a cursor comparator 106. The cursor comparator 106 feeds a cursor controller 108, which in turn controls a cursor RAM 110 and cursor multiplexers 112.

In general, the registers 102 are used to store the position of the cursor 74 as requested by software, the match position of the cursor representing the difference between the hot point 78 and the origin 76 of the cursor, and a bit used to enable vertical and horizontal blanking offsets for partially blanked cursor displays. The X-Y counter 104 counts the horizontal blank time in pixels and the vertical blank time in scan lines if offsets are enabled, and feeds these values to the cursor comparator 106 via lines 107. The cursor comparator 106 adds the offset values to the cursor position values loaded in the registers 102 and subtracts from the result the horizontal and vertical match position values. The result of the subtraction is compared to the horizontal and vertical count values supplied by the CRT controller 40 (FIG. 2), which represent the position on the screen which is currently being refreshed. Upon a successful comparison, XMATCH and YMATCH are sent to the cursor controller 108, which then causes cursor data and transparency data from the cursor RAM 110 to be multiplexed by multiplexers 112 onto the cursor data lines 54 and transparency lines 55 (FIG. 2). Thus, horizontal and vertical blanking offsets and cursor match positions are automatically taken into account by the hardware, eliminating the software overhead traditionally associated with these tasks.

Specifically, the registers 102 include five registers which are loadable via the I/O bus 24. The X_POS and $Y_{13}$ POS registers store cursor position data. In particular, the X_POS register 114 is loaded with the desired horizontal pixel position of the cursor hot point 78. The Y_POS register 116 is loaded with the desired vertical scan line position of the cursor hot point 78.

The DX and DY registers store the cursor match position. In particular, the DX register 118 is loaded with the difference in horizontal pixels between the cursor hot point 78 and the cursor origin 76. The DY register 120 is loaded with the difference in vertical scan lines between the cursor hot point 78 and the cursor origin 76. The values in the DX and DY registers will be zero when the hot point 78 corresponds to the origin 76.

The OFFSET_ENABLE register 122 is a bit which, when set, enables horizontal and vertical blank offsets to be added to the cursor position data.

The OFFSET_ENABLE bit is fed to the X-Y Counter 104, which also accepts as input the CSYNC and CBLANK video timing signals from the CRT controller 40 on lines 52 (FIG. 2), a divide down clock D4CLK from the clock generator on lines 39 (FIG. 2), and the VSYNC timing signal from the sync state machine 100. The X-Y counter 104 generates horizontal and vertical count signals HOFFCNT and VOFFCNT on lines 124, which are fed to the cursor comparator 106.

Figure 6:
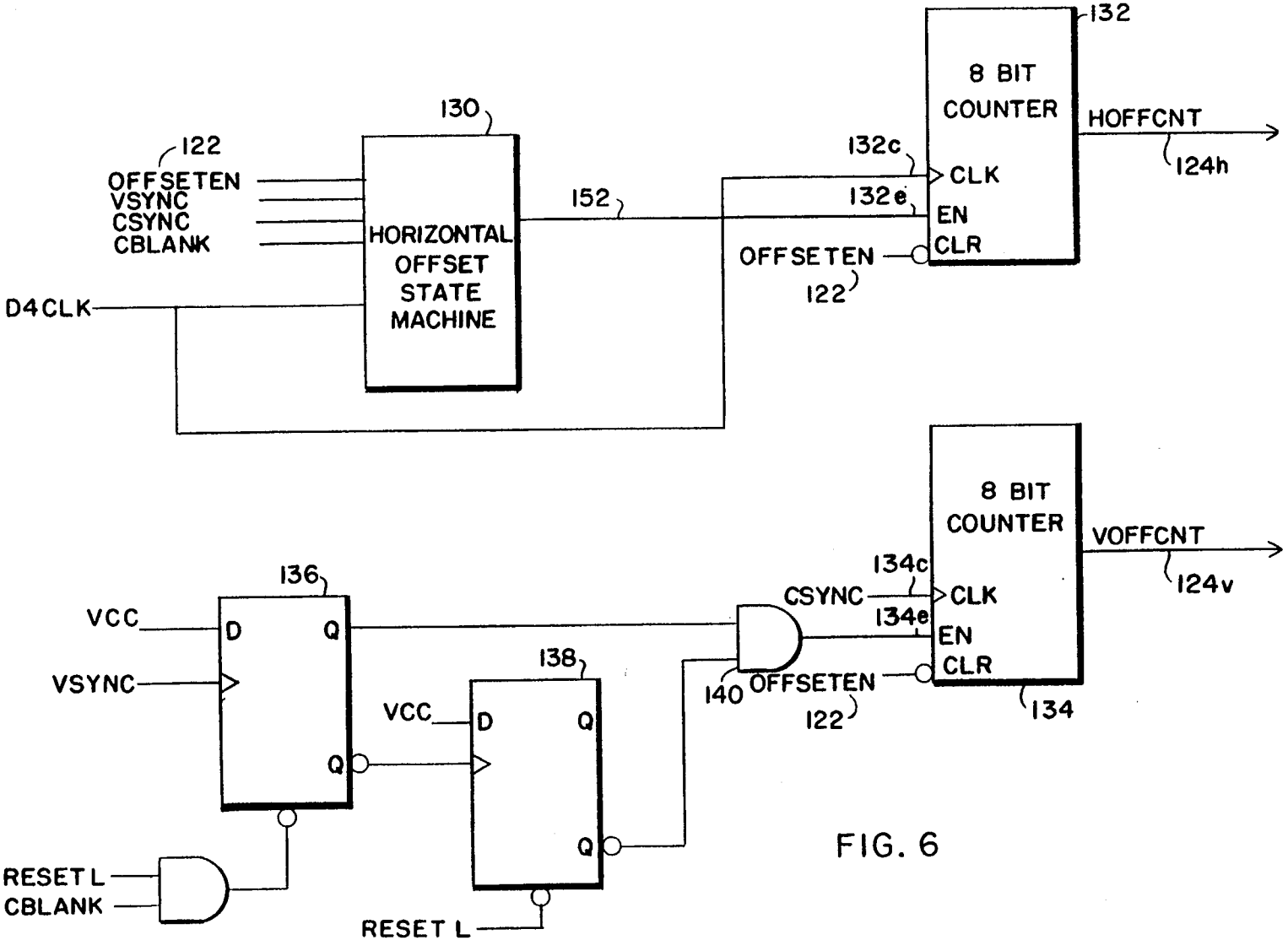
FIG. 6 is a block diagram of the X-Y counter of FIG. 5.

Referring now to FIG. 6, there is shown the X-Y counter 104 in further detail. The X-Y counter 104 includes a horizontal offset state machine 130 coupled to a horizontal 8-bit counter 132 for generating the horizontal count signal HOFFCNT on lines **124*h*. Also included is an vertical 8-bit counter 134 for generating the vertical count signal VOFFCNT on lines 124*v*, which is fed by flip flops 136 and 138**.

When the OFFSET_ENABLE bit 122 is reset, such that blanking offsets are disabled, the 8-bit counters 132 and 134 are cleared and the values of the resulting count signals HOFFCNT and VOFFCNT are zero. When the OFFSET_ENABLE bit 122 is set, such that blanking offsets are enabled, the 8-bit counters 132 and 134 increment the HOFFCNT and VOFFCNT signals according to their respective clock (CLK) and enable (EN) inputs.

The clock (CLK) input **134*c* of the vertical 8-bit counter 134 is fed by the video timing signal VSYNC; thus, the counter 134 will increment once per vertical line while enabled via enable input 134*e*. The 'Q' outputs of the flip flops 136 and 138 are initially reset upon the assertion of the "Reset L" signal at power-up, and thus the 'Qbar' output of the flip flop 138 is set. The 'Q' output of the flip flop 136 is set on the rising edge of the VSYNC signal when the CBLANK signal is active, thus enabling the counter 134 through the AND gate 140. When CBLANK is de-asserted, indicating the end of a vertical blank, the 'Qbar' output of the flip flop 138 is reset, thus disabling the counter 134. The counter 134 is thereby enabled upon the assertion of the VSYNC signal, and disabled upon the assertion of the CBLANK signal, thus counting the number of vertical lines during the vertical front porch (FIG. 4). This value is maintained on VOFFCNT lines 124*v* until either a system reset occurs or until the OFFSET_ENABLE bit 122** is reset.

The clock input **132*c* of the horizontal counter 132 is fed by the divide down clock D4CLK, and thus will increment the value of HOFFCNT by 4 pixels per clock when enabled via the enable input 132*e*. The enable input 132*e* is fed by the horizontal offset state machine 130**.

Figure 7:
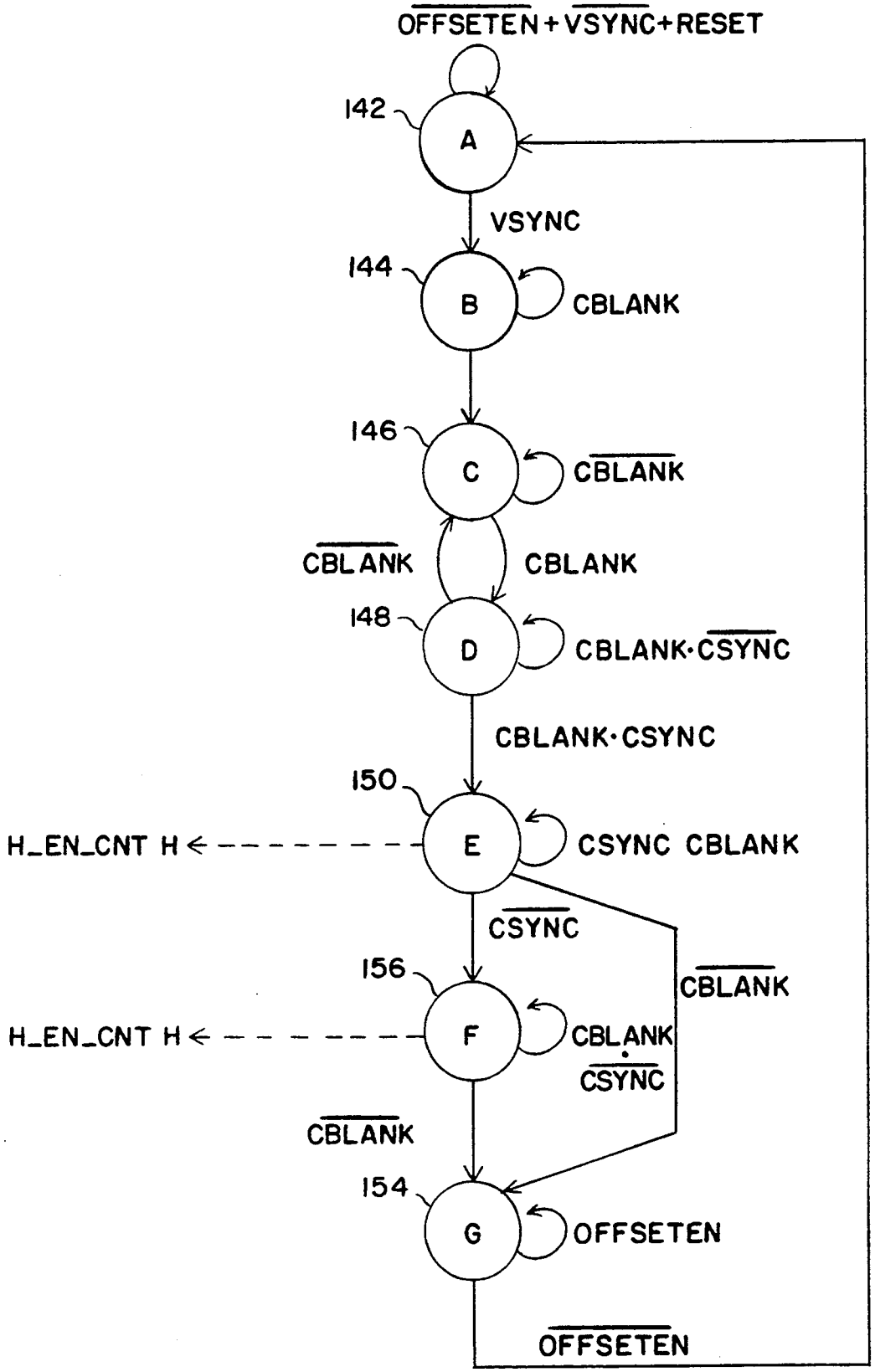
FIG. 7 is a state diagram of the horizontal offset state machine of FIG. 6.

Referring now to FIG. 7, there is shown a state diagram of the horizontal offset state machine 130. The horizontal offset state machine 130 accepts as input the video timing signals VSYNC, CSYNC, and CBLANK, and the OFFSET_ENABLE bit 122. The machine 130 is controlled by clock D4CLK. Upon a system reset the machine waits in state A (142) for the assertion of the VSYNC signal, upon which it proceeds to state B (144). The machine 130 waits in state B for the de-assertion of the CBLANK signal, indicating the end of the vertical front porch, and proceeds to state C (146). The machine 130 waits in state C for the assertion of the CBLANK signal, indicating the beginning of the horizontal back porch. When CBLANK is asserted the machine 130 proceeds to state D (148), where it waits for the assertion of CSYNC. When CSYNC is asserted, the machine 130 proceeds to state E (150), which marks the start of the horizontal retrace. In state E the H_EN_CNT signal is set, enabling the counter 132 via line 152. In the event that the CBLANK and CSYNC signals are de-asserted at the same time (indicating no horizontal back porch), the machine 130 proceeds to state G (152), where it remains until either the machine is reset or until blanking offsets are disabled as indicated by the de-assertion of the OFFSET_ENABLE bit 122, in which case the machine returns to state A (142). If the CSYNC signal deasserts while the CBLANK signal remains asserted, the machine proceeds from state E (150) to state F (154) where H_EN_CNT remains asserted for the duration of the horizontal back porch. Upon the deassertion of CBLANK, the machine 130 proceeds to state G (154) and proceeds as described above.

Thus, the horizontal offset state machine 130 enables the horizontal 8-bit counter 132 during the horizontal sync pulse time and the horizontal back porch when blanking offsets are enabled as indicated by the assertion of the OFFSET_ENABLE bit 122. The value counted will remain asserted on the HOFFCNT lines **124*h* until offsets are disabled by resetting the OFFSET_ENABLE bit 122** or until the system is reset.

The VOFFCNT and HOFFCNT offset values are fed to the cursor comparator 106 (FIG. 5), which uses these values and the match point data and cursor position data stored in registers 102 to generate signals XMATCH and YMATCH on lines 160.

Figure 8:
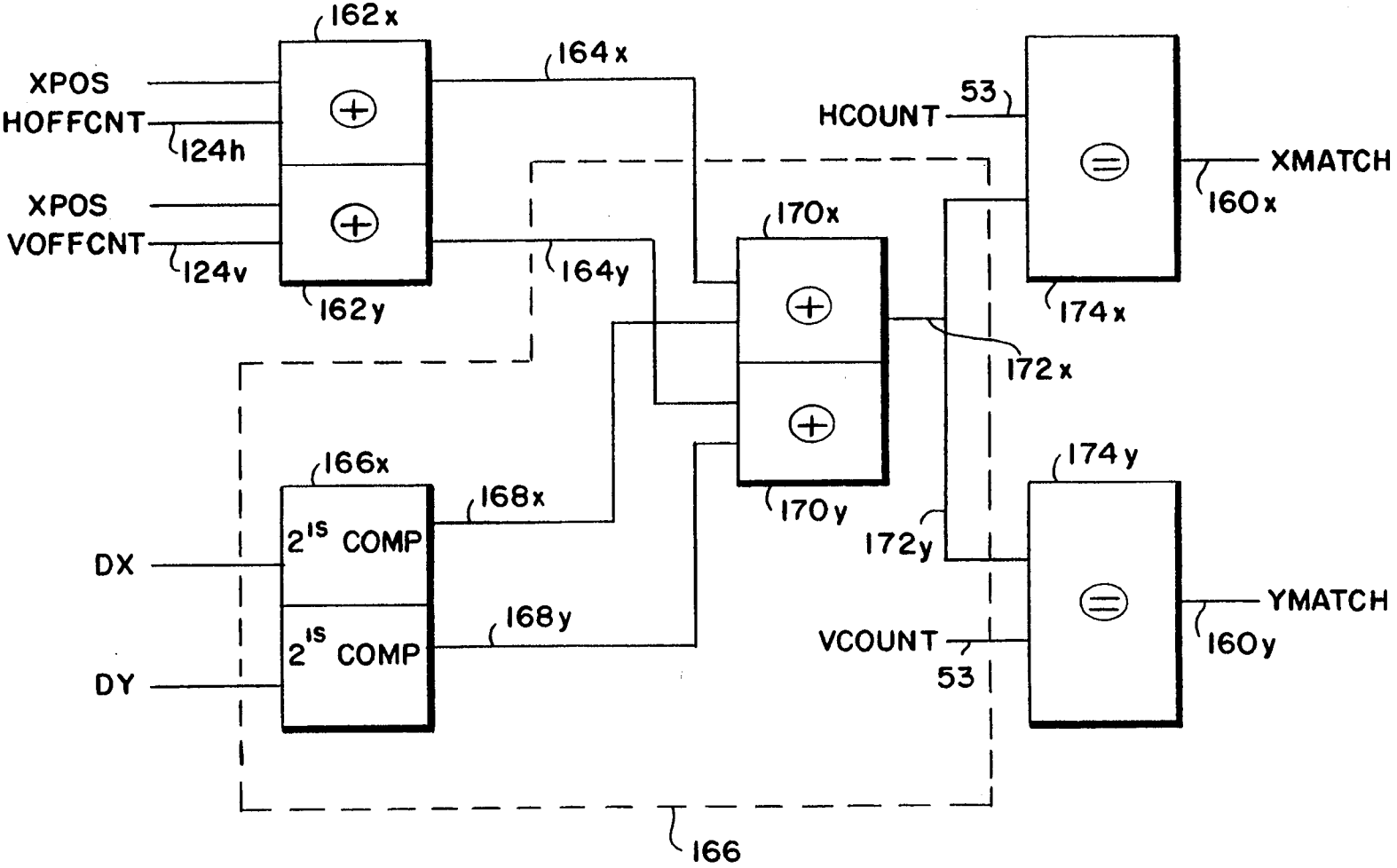
FIG. 8 is a block diagram of the cursor comparitor of FIG. 5.

Referring now to FIG. 8, there is shown the cursor comparator 106 in further detail. The cursor comparator 106 accepts as input the VOFFCNT and HOFFCNT offset valued, the contents of the XPOS register 114 (FIG. 5), the contents of the YPOS register 116, the contents of the DX register 118, the contents of the DY register 120, and the HCOUNT and VCOUNT signals on lines 52 from the CRT controller 40, and generates therefrom the XMATCH and YMATCH signals on lines 160. The XMATCH and YMATCH signals correspond to the position of the cursor 74 adjusted to take into account the blanking offsets and the match position of the cursor.

In particular, the XPOS data, indicating the horizontal pixel position of the cursor as seen by software, is added to the HOFFCNT value on lines **124*h* by adder 162*x* to produce x-offset position data on lines 164*x*. Likewise, the YPOS data, indicating the vertical scan line position of the cursor 74 as seen by software, is added to the VOFFCNT value on lines 124*v* by adder 162*y* to provide y-offset position data on lines 164*y***. Horizontal and vertical blanking times are thus added to the cursor position value.

Further, the contents of the DX and DY registers representing the match position of the cursor, are subtracted by subtractor 166 from the offset position values on lines 164x and 164y. In particular, the DX value representing the horizontal portion of the match position is fed to a 2's complement circuit 166x which outputs the 2's complement of the horizontal match position data on lines 168x. The 2's complement horizontal match position data on lines 168x is added by an adder 170x to the x-offset position data on lines 164x, effectively subtracting the DX value initially stored in the register 118 from the X-offset position on lines 164x. The result is output as adjusted horizontal position data on lines 172x. Likewise, the DY value representing the vertical portion of the match position is fed to a 2's complement circuit 166y which outputs the 2's complement of the vertical match position data on lines 168y. The 2's complement vertical match position data on lines 168y is added by an adder 170y to the y-offset position data on lines 164y by an adder 170y, effectively subtracting the DY value initially stored in the register 120 from the Y-offset position on lines 164y. The result is output as adjusted vertical position data on lines 172y.

The adjusted horizontal position data on lines 172x is compared by comparator 174x to the HCOUNT signal which represents the horizontal pixel position on the display 34 that is currently being refreshed. When the value of the adjusted horizontal position data on lines 172x is equal to the value of the HCOUNT signal, the XMATCH signal on lines 160x is asserted. Likewise, the adjusted vertical position data on lines 172y is compared by comparator 174y to the VCOUNT signal which represents the vertical scan line on the display 34 that is currently being refreshed. When the value of the adjusted vertical position data on lines 172y is equal to the value of the VCOUNT signal, the YMATCH signal on lines 160y is asserted.

The XMATCH and YMATCH outputs of the cursor comparator 106 are fed as input to the cursor controller 108 (FIG. 5). The XMATCH and YMATCH signals indicate to the cursor controller 108 that cursor data is to be displayed at the position on the display 34 currently being refreshed; thus, the cursor controller 108 responds to the assertion of the XMATCH and YMATCH signals by initiating operations to shift cursor data from the cursor RAM 110 to the multiplexers 112, which multiplex the cursor and transparency data onto lines 54 and 55 for display by the video controller 28.

Figure 9:
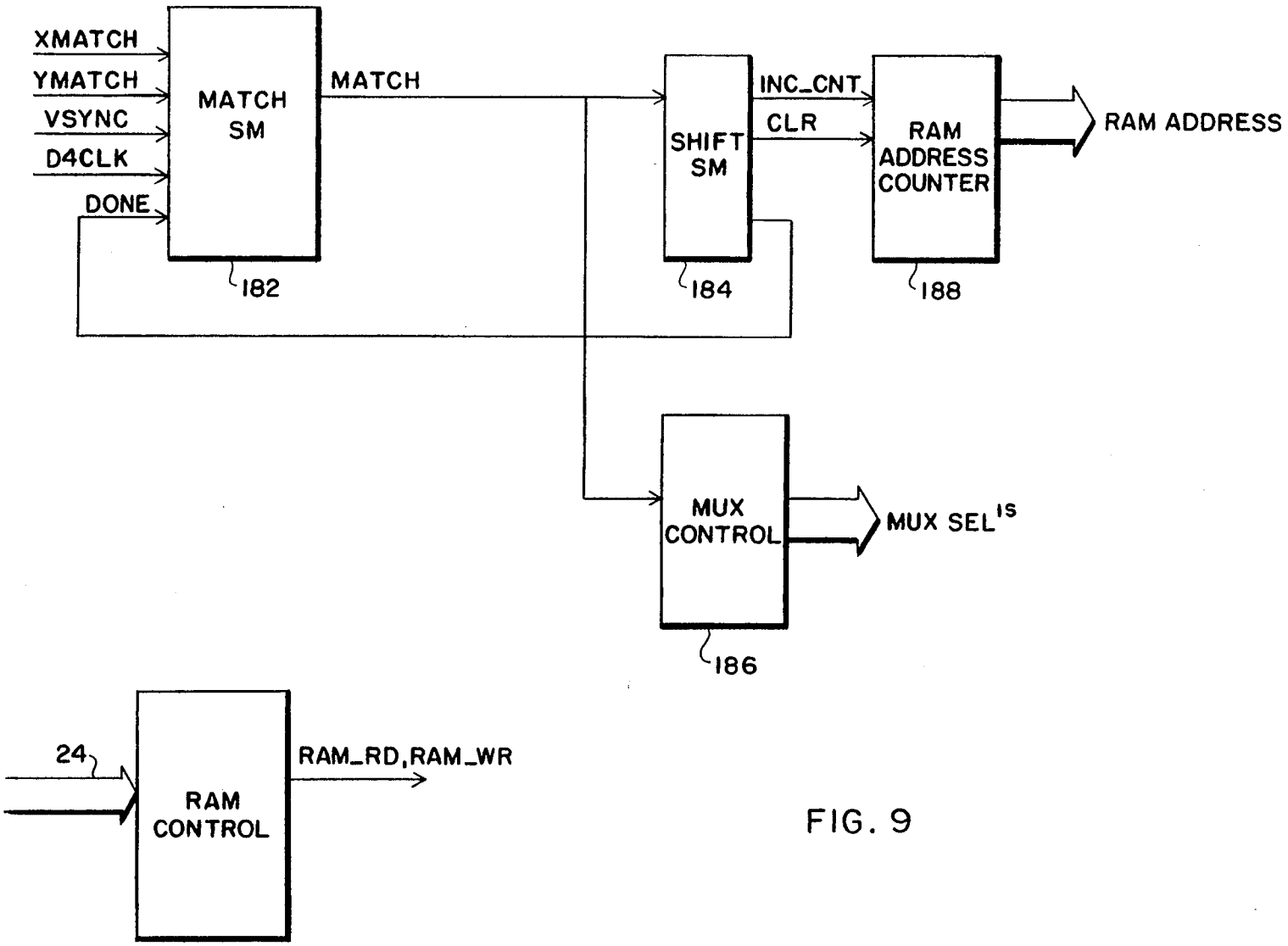
FIG. 9 is a block diagram of the cursor controller of FIG. 5.

Referring now to FIG. 9, the cursor controller is shown to include a RAM control circuit 180 coupled to the I/O bus 24 for generating control signals RAM_RD and RAM_WR for reading and writing to the cursor RAM 110 (FIG. 5), and a match state machine 182 coupled to a shift machine 184. Also included is a multiplexer control machine 186 for generating multiplexer select signals on lines 109 (FIG. 5). The shift machine 184 is coupled to a RAM address counter 188 which generates RAM address signals used by the cursor RAM 110.

The match state machine 182 accepts as input the divide down clock D4CLK and the XMATCH and YMATCH signals from the cursor comparator 106, as well as the VSYNC video timing signal and a DONE signal and a YADDHI signal from the shift machine 184. The match state machine 182 generates therefrom an output signal CLR_ADD which is fed to the shift machine 184 and an output MATCH which is fed to both the shift machine 184 and the multiplexer control machine 186.

Figure 10:
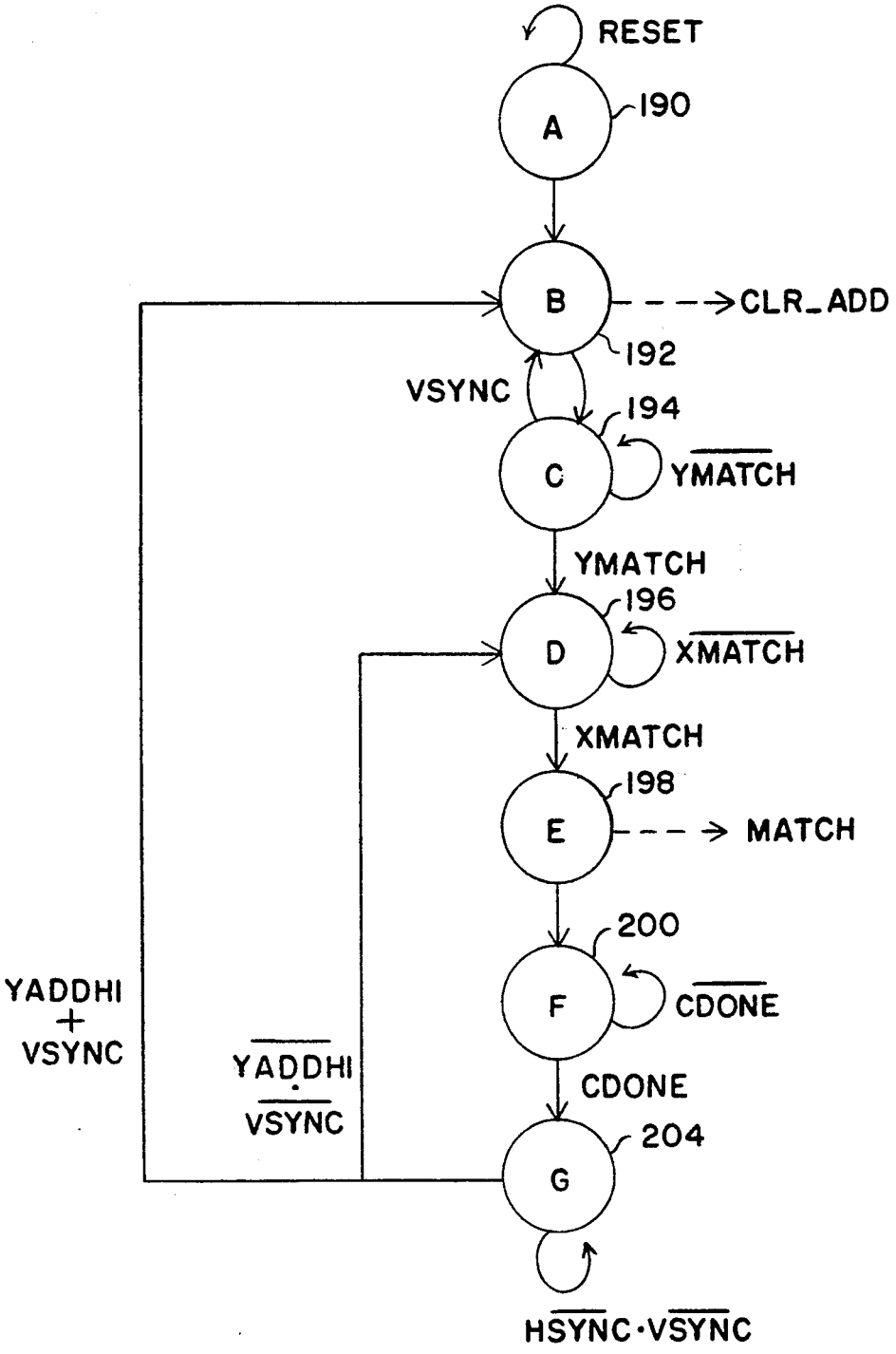
FIG. 10 is a state diagram of the match state machine of FIG. 9.

Referring now to FIG. 10, there is shown a state diagram of the match state machine 182. Upon a system reset, the machine 182 proceeds on the D4CLK edge from state A (190) to state B (192) where it generates the output signal CLR_ADD. The machine 182 then proceeds to state C (194), where it awaits the assertion of the YMATCH signal, indicating that the current scan line is one in which the cursor 74 is to be displayed. Upon assertion of the YMATCH signal, the machine 182 proceeds to step D (196), where it awaits the assertion of the XMATCH signal, indicating that the horizontal pixel position at which the cursor 74 is to be displayed has been reached. Upon assertion of the XMATCH signal, the machine 182 proceeds to step E (198), where it outputs the signal MATCH. On the next D4CLK clock edge, the machine 182 proceeds to step F (200), where it awaits the assertion of the CDONE signal from the shift machine 184, indicating that all the cursor data for the present scan line has been shifted out of the cursor RAM 110. Upon the assertion of the CDONE signal, the machine 182 proceeds to state G (202), where it awaits one of two events. If either VSYNC is asserted, indicating the end of the current sweep, or YADDHI is asserted, indicating that the last vertical line of the cursor has been displayed, the machine 182 proceeds from state G (202) to state B (192), where it asserts CLR_ADD to clear the shift machine 184 and proceeds to await the next assertion of the YMATCH signal. If neither the YADDHI signal or VSYNC signal are asserted, however, the machine proceeds from state G (202) to state D (196). This condition occurs when successive scan lines containing cursor information are yet to be displayed.

Thus the match state machine 182 asserts the signal CLR_ADD prior to the time at which the cursor is to be displayed on the screen, and asserts the MATCH signal at the horizontal pixel position at which the cursor 74 is to be displayed for each vertical scan line in which the cursor 74 is to be displayed.

The shift machine 184 accepts as input the MATCH and CLR_ADD signals, and generates as output the signals CLR and INC_CNT which are fed to the RAM address counter 188.

The cursor RAM 110 (FIG. 5) stores 64×64 pixels of cursor and transparency data; thus, for a three color pixel requiring 2 bits per pixel, each scan line of pixel information requires 128 bits. The cursor RAM 110 is configured as a pair of 128×32 RAMs, thus 4 address increments per RAM will be required to shift out the cursor and transparency data for each scan line during which the cursor is displayed.

The shift machine 184 thus responds to the CLR_ADD signal by asserting a CLRCNT signal which is fed to the RAM address counter and used to clear the RAM address to 0. The shift machine 184 then responds to the MATCH signal by asserting the INC_CNT signal four times at appropriate intervals. The RAM address counter 188 responds to the INC_CNT signal by incrementing the address presented to the cursor RAM 110. The shift state machine 184 provides further output signals in response to the MATCH signal to initiate the reading of data from the cursor RAM 110 at the address presented by the RAM address counter 188.

The multiplexer control machine 186 also responds to the MATCH signal from the match state machine 182 by asserting as outputs the multiplexer select signals on lines 109, properly sequenced to multiplex the output of the cursor RAM 110.

Referring back to FIG. 5, the multiplexers 112 accept as input the multiplexer select signals on lines 109 and the cursor RAM data on lines 111, all responsive to the MATCH signal generated within the cursor controller 108. The multiplexers 112 use the multiplexer select signals on lines 109 to multiplex the 128 bits of cursor RAM data on lines 109 onto eight bits of cursor data on lines 54 (FIG. 2) and four bits of transparency data on lines 55 in a conventional manner.

EXAMPLE

Figure 11:
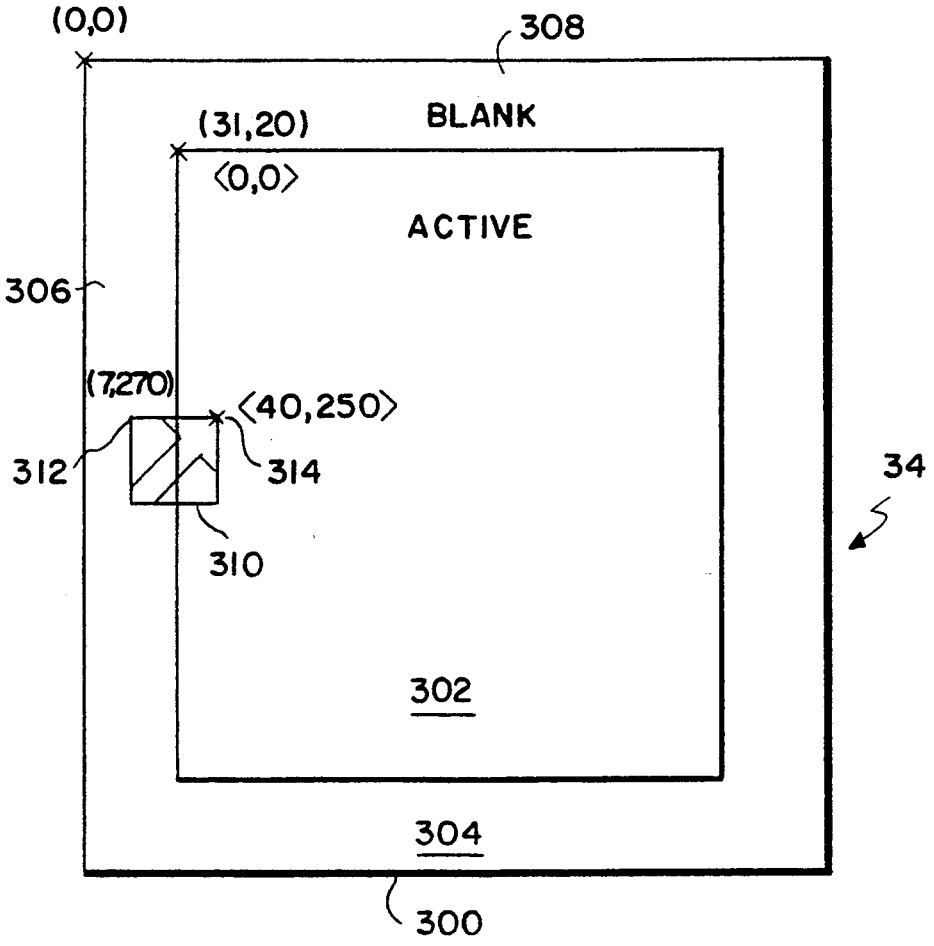
FIG. 11 is an example of cursor positioning on a video display.

The hardware cursor 42 positions the cursor relative to the HSYNC and VSYNC video timing signals while providing blanking offsets and match position offsets in a manner which is transparent to software, allowing software to place the cursor relative to the first pixel position on the screen. Referring now to FIG. 11, there is shown an example of cursor positioning using the hardware cursor 42 of FIG. 2. The display 300 of FIG. 11 is shown to display an active region 302 surrounded by a blank region 304. The blank region 304 includes a horizontal back porch 306 and a vertical back porch 308. Also shown is a cursor 310 with an origin 312. Software requests that a cursor 310 with a hot point 314 at the upper right corner of the 64×64 pixel matrix be displayed at (x,y) pixel position (40, 250). Positions on the display 300 as used by software are indicated by the <x,y> convention, while actual positions as seen by the hardware cursor 42 are indicated as (x,y).

In order to ensure that blanking and match position offsets are transparent to software, the software sets the OFFSET_ENABLE bit 122 in the cursor registers 102 within the hardware cursor 42. Software also loads the DX and DY registers 118 and 120 with the match position of the cursor 310; that is, with the difference in position between the hot point and the cursor origin. Since the cursor origin is in the upper left corner of the 64×64 cursor matrix, and the hot point is in the upper right corner, the DX register 118 is loaded with a value of 63, and the DY register 120 is loaded with a value of 0 (or left at its default value of 0).

Software now commands that the cursor be positioned at pixel location <40,250> relative to the first pixel displayed in the active region 302 at the upper left corner of the display. Thus, the XPOS register 114 is loaded with a value of 40, and the YPOS register 116 is loaded with a value of 250.

The hardware cursor 42 positions the cursor 306 on the display 300 relative to the HSYNC and VSYNC timing signals; thus, the (0,0) position is located at the start of the blank region 304. Since the OFFSET_ENABLE bit 122 has been set, the hardware cursor 42 counts the number of blank horizontal pixels in the horizontal back porch 306, here 31 pixels, and adds the result to the value stored in the XPOS register 114 (FIG. 6, 7). From this addition, the value in the DX register 118, indicating the horizontal match position, is subtracted. Thus the horizontal position of the hardware cursor origin 312 is calculated to be $(40+31-63)=8$. Likewise, the hardware cursor 42 counts the number of vertical scan lines in the vertical back porch 308, here 20 scan lines, and adds the result to the value stored in the YPOS register 116. From this result is subtracted the value stored in the DY register 120, here 0, resulting in a vertical position for the hardware cursor origin 312 of $(250+20-0)=270$.

Thus, software commands that the hot point 314 of the cursor 310 be positioned at <40,250>, and the hardware cursor 42 responds by positioning the cursor origin 312 at an actual screen location of (8,270). As a result of such positioning, the left portion of the cursor 306 corresponding to horizontal screen positions 8 through 31 is blanked by the horizontal back porch, while the portion of the cursor 306 in which the hot point 310 resides appears in the active region 302. The partial blanking and match position offsets have thereby been implemented in a manner transparent to software. Backwards compatibility with software which contains blanking offset and match position support is maintained by disabling the OFFSET_ENABLE bit 122 and leaving the DX and DY registers and 120 at a value of 0.

It is apparent that, within the scope of the invention, modifications and different arrangements may be made other than as herein disclosed. The present disclosure is merely illustrative, the invention comprehending all variations thereof.

What is claimed is:

1. Apparatus for positioning a cursor on a video display having an active region for displaying an image, the active region being surrounded by a blank region, the blank region resulting from signals providing a horizontal blank time and a vertical blank time, the image being formed of successively refreshed pixels, the cursor being displayed as a pixel matrix and having a cursor origin in a corner of the matrix and a cursor hot point located within the matrix, comprising:

an X position register for storing an X cursor position coordinate;

a Y position register for storing a Y cursor position coordinate;

an X counter for counting the number of horizontal pixels in the horizontal blank time to provide a horizontal offset value;

an X adder coupled to the X counter and to the X position register for adding the horizontal offset value to the contents of the X position register to provide a horizontal offset position;

a Y counter for counting the number of scan lines in the vertical blank time to provide a vertical offset value;

a Y adder coupled to the Y counter and to the Y position register for adding the vertical offset value to the contents of the Y position register to provide a vertical offset position;

a first subtracting circuit for subtracting from the horizontal offset position a horizontal match position representing the difference between the horizontal position of the hot point and the horizontal position of the origin to provide a horizontal adjusted position;

a second subtracting circuit for subtracting from the vertical offset position a vertical match position representing the difference between the vertical position of the hot point and the vertical position of the origin to provide a vertical adjusted position; and means for displaying the cursor at the position corresponding to the horizontal adjusted position and the vertical adjusted position.

2. The apparatus of claim 1 wherein the first subtracting circuit comprises:

a DX register for storing the difference between the horizontal position of the hot point and the horizontal position of the origin to provide the horizontal match position; and an X subtractor coupled to the X adder and to the DX register for subtracting the horizontal match position from the horizontal offset position to provide the horizontal adjusted position.

3. The apparatus of claim 1 wherein the second subtracting circuit comprises:

a DY register for storing the difference between the vertical position of the hot point and the vertical position of the origin to provide the vertical match position; and a Y subtractor coupled to the Y adder and to the DY register for subtracting the vertical match position from the vertical offset position to provide the vertical adjusted position.

4. The apparatus of claim 1 wherein the means for displaying comprises:

a memory storing the cursor pixel matrix to be displayed;

means for comparing the horizontal adjusted position to a value representing the horizontal pixel position on the display which is currently being refreshed to provide an XMATCH signal when the horizontal adjusted position is equal to the horizontal pixel position currently being refreshed;

means for comparing the vertical adjusted position to a value representing the vertical scan line position on the display which is currently being refreshed to provide a YMATCH signal when the vertical adjusted position is equal to the vertical scan line currently being refreshed; and means for forwarding the contents of the memory to the display upon the assertion of the XMATCH and YMATCH signals.

5. Apparatus for positioning a cursor on a video display having an active region for displaying an image, the active region being surrounded by a blank region, the blank region resulting from signals providing a horizontal blank time and a vertical blank time, the image being formed of successively refreshed pixels, the cursor being displayed as a pixel matrix and having a cursor origin in a corner of the matrix and a cursor hot point located within the matrix, comprising:

an X position register for storing an X cursor position coordinate;

a Y position register for storing a Y cursor position coordinate;

an X counter for counting the number of horizontal pixels in the horizontal blank time to provide a horizontal offset value;

an X adder coupled to the X counter and to the X position register for adding the horizontal offset value to the contents of the X position register to provide a horizontal offset position;

a Y counter for counting the number of scan lines in the vertical blank time to provide a vertical offset value;

a Y adder coupled to the Y counter and to the Y position register for adding the vertical offset value to the contents of the Y position register to provide a vertical offset position;

a DX register for storing the difference between the horizontal position of the hot point and the horizontal position of the origin to provide a horizontal match position;

an X subtractor coupled to the X adder and to the DX register for subtracting the horizontal match position from the horizontal offset position to provide a horizontal adjusted position;

a DY register for storing the difference between the vertical position of the hot point and the vertical position of the origin to provide a vertical match position;

a Y subtractor coupled to the Y adder and to the DY register for subtracting the vertical match position from the vertical offset position to provide a vertical adjusted position;

a memory storing the cursor pixel matrix to be displayed;

means for comparing the horizontal adjusted position to a value representing the horizontal pixel position on the display which is currently being refreshed to provide an XMATCH signal when the horizontal adjusted position is equal to the horizontal pixel position currently being refreshed;

means for comparing the vertical adjusted position to a value representing the vertical scan line position on the display which is currently being refreshed to provide a YMATCH signal when the vertical adjusted position is equal to the vertical scan line currently being refreshed; and means for forwarding the contents of the memory to the display upon the assertion of the XMATCH and YMATCH signals.

* * * * *